US009675123B2

(12) United States Patent
Brohmer

(10) Patent No.: US 9,675,123 B2
(45) Date of Patent: Jun. 13, 2017

(54) PADDING SYSTEM FOR MEDICAL CLOTHING

(71) Applicant: Platinum Scrubs LLC, Waukesha, WI (US)

(72) Inventor: Sylvia Brohmer, Corpus Christi, TX (US)

(73) Assignee: Platinum Scrubs LLC, Waukesha, WI (US)

( * ) Notice: Subject to any disclaimer, the term of this patent is extended or adjusted under 35 U.S.C. 154(b) by 109 days.

(21) Appl. No.: 14/604,329

(22) Filed: Jan. 23, 2015

(65) Prior Publication Data

US 2015/0201685 A1 Jul. 23, 2015

Related U.S. Application Data

(60) Provisional application No. 61/930,560, filed on Jan. 23, 2014.

(51) Int. Cl.
*A41D 13/06* (2006.01)
*A41D 1/06* (2006.01)

(52) U.S. Cl.
CPC ..... *A41D 13/065* (2013.01); *A41D 1/06* (2013.01)

(58) Field of Classification Search
CPC .... A41D 13/1236; A41D 13/065; A41D 1/06; A41D 13/015
USPC ..... 2/23
See application file for complete search history.

(56) References Cited

U.S. PATENT DOCUMENTS 105,856 A * 7/1870 Sloan ..... A41D 1/10 2/231
337,316 A * 3/1886 Erlanger ..... A41D 1/10 2/231
907,050 A * 12/1908 Hestness ..... A41D 13/0593 2/23
1,304,613 A * 5/1919 Smedley ..... A41D 1/06 2/227
D54,284 S 12/1919 Sollen
1,654,452 A * 12/1927 Bradley ..... A41D 13/065 2/227
2,568,083 A * 9/1951 Mitchell ..... A41D 13/0556 2/23
4,091,466 A * 5/1978 Kearn ..... A41D 13/015 2/227
4,100,620 A * 7/1978 Pecoraro ..... A41D 13/0518 2/102
4,213,202 A * 7/1980 Larry ..... A41D 31/005 2/456
4,272,850 A * 6/1981 Rule ..... A41D 13/065 2/24

(Continued)

FOREIGN PATENT DOCUMENTS

WO WO2011103466 8/2011

*Primary Examiner* — Nathan Durham
*Assistant Examiner* — Anne Kozak
(74) *Attorney, Agent, or Firm* — Boyle Fredrickson, S.C.

(57) ABSTRACT

A knee padding for scrub pants may include a base layer having a first surface area and a plurality of intermediate layers wherein each one of the intermediate layers has a progressively larger surface area than the intermediate layer proximate the base layer, thus forming a stepped pyramid-like padding. The padding may form a knee pad and be secured to scrub pants with stitching creating a uniform pattern.

11 Claims, 5 Drawing Sheets

(56) References Cited

U.S. PATENT DOCUMENTS 4,287,885 A * 9/1981 Applegate ..... A61F 13/061 2/24
4,397,043 A * 8/1983 Croteau ..... A41D 13/02 2/22
4,455,686 A * 6/1984 Zide ..... A41D 1/08 2/23
4,561,123 A * 12/1985 Hull ..... A41D 13/0562 2/16
4,561,124 A * 12/1985 Thompson ..... A41D 1/067 2/227
4,608,716 A * 9/1986 Brumfield ..... A41D 13/015 2/102
4,831,666 A * 5/1989 Denman ..... A41D 13/065 2/23
4,920,577 A * 5/1990 Scharf ..... A41D 1/067 2/22
5,038,408 A * 8/1991 DeBaene ..... A41D 13/0537 2/227
5,105,473 A * 4/1992 Valtakari ..... A41D 13/015 2/22
5,134,726 A * 8/1992 Ross ..... A41D 1/08 2/22
5,219,367 A * 6/1993 Fields ..... A62B 17/001 2/227
5,277,954 A * 1/1994 Carpenter ..... A61F 13/041 428/159
5,411,037 A * 5/1995 Hess ..... A61F 5/0109 128/882
5,513,407 A * 5/1996 Reinert, Sr. ..... D06F 95/00 8/158
5,539,926 A * 7/1996 Mantos ..... A41D 1/08 2/228
5,572,737 A * 11/1996 Valice ..... A41D 1/067 2/22
5,634,215 A * 6/1997 DeBaene ..... A41D 1/067 2/227
5,658,246 A * 8/1997 Saca ..... A41D 13/015 2/455
5,659,895 A * 8/1997 Ford, Jr. ..... A62B 17/008 2/2.11
5,742,939 A * 4/1998 Williams ..... A41D 1/00 2/456
5,840,397 A * 11/1998 Landi ..... A41D 13/05 428/116
5,845,333 A * 12/1998 Crampton ..... A41D 13/065 2/24
5,896,580 A * 4/1999 Aldrich ..... A41D 13/065 2/22
5,918,310 A * 7/1999 Farahany ..... A41D 13/015 2/228
5,918,319 A * 7/1999 Baxter ..... A41D 1/067 2/22
5,920,902 A * 7/1999 Crampton ..... A41D 13/0593 2/23
5,940,881 A * 8/1999 Murphy ..... A41D 13/08 2/125
6,014,771 A * 1/2000 Kirven ..... A41D 1/08 2/227
6,041,437 A * 3/2000 Barker ..... A41D 1/067 156/278
6,093,468 A * 7/2000 Toms ..... A41D 13/0158 2/22
6,098,196 A * 8/2000 Logan ..... F41H 1/02 2/2.5
6,127,007 A * 10/2000 Cox ..... F41H 3/00 2/1
6,347,413 B1 * 2/2002 Sciscente ..... A41D 13/0575 2/23
6,421,839 B1 * 7/2002 Vo ..... A41D 13/0575 2/227
6,425,135 B1 * 7/2002 Aldrich ..... A41D 13/0593 2/22
6,704,938 B2 3/2004 Crockett
6,769,134 B1 8/2004 Mendez
6,810,534 B2 * 11/2004 Durkin ..... A41D 13/0581 2/267
7,089,596 B2 * 8/2006 Leflet ..... A41D 1/086 2/23
7,194,770 B1 3/2007 Fecenko
7,216,370 B1 * 5/2007 Warner ..... A41D 13/0575 2/23
7,296,301 B1 * 11/2007 Conn ..... A41D 13/065 2/23
7,484,250 B2 * 2/2009 Chiang ..... A41D 13/0506 2/465
7,543,338 B2 * 6/2009 Culhane ..... A41D 1/067 2/93
D632,020 S * 2/2011 Onrot ..... D29/120.1
7,891,018 B2 * 2/2011 Atkinson ..... A41B 13/00 2/24
7,913,319 B1 * 3/2011 Iannace ..... A41D 13/065 2/24
7,913,322 B2 3/2011 Aldridge
7,945,968 B2 5/2011 Johnson
7,975,634 B1 * 7/2011 Dugan ..... A41D 13/065 112/475.06
7,979,918 B2 * 7/2011 Sandusky ..... F41H 5/0492 2/2.5
7,992,221 B2 * 8/2011 Sonner ..... F41H 1/02 2/69
8,108,945 B2 * 2/2012 Sanchez ..... A41D 13/065 2/24
8,141,170 B2 3/2012 Paterno
8,166,570 B2 5/2012 Matuszak et al.
8,181,271 B2 5/2012 Sasaki et al.
8,220,073 B2 7/2012 Lopez et al.
8,272,073 B2 * 9/2012 Arensdorf ..... A41D 1/08 2/228
D690,080 S 9/2013 Grosbol
D690,083 S * 9/2013 Grosbol ..... D2/742
D690,085 S * 9/2013 Grosbol ..... D2/743
D696,487 S * 12/2013 Kurmanow ..... D2/742
D718,000 S * 11/2014 Westphal ..... D29/101.5
D735,445 S * 8/2015 Hare ..... D2/743
9,364,034 B2 * 6/2016 Best ..... A41D 13/0005
2003/0000003 A1 * 1/2003 Boersema ..... A41B 11/008 2/69
2004/0078873 A1 * 4/2004 Goodwin ..... A41D 13/0593 2/267
2005/0060782 A1 * 3/2005 Sallas ..... A41D 11/00 2/23
2005/0203454 A1 * 9/2005 Wiener ..... A41D 13/0506 602/23
2005/0229282 A1 * 10/2005 Davis ..... A41D 13/0575 2/69
2006/0117451 A1 * 6/2006 Sciortino ..... A41B 13/00 2/23
2007/0022519 A1 * 2/2007 South ..... A41B 11/02 2/239
2008/0047043 A1 * 2/2008 Flores-Garvey ..... A41B 13/005 2/79
2008/0307553 A1 * 12/2008 Jbeili ..... F41H 5/0428 2/2.5
2009/0013442 A1 * 1/2009 Matuszak ..... A41D 13/065 2/23
2009/0048550 A1 * 2/2009 Feeley ..... A41D 13/065 602/26
2010/0036303 A1 * 2/2010 Bauerfeind ..... A61F 5/0106 602/26
2012/0116282 A1 * 5/2012 Cros ..... A61F 13/08 602/76
2012/0255105 A1 * 10/2012 Turner ..... A41D 13/0506 2/455
2014/0259325 A1 * 9/2014 Behrend ..... A41D 13/06 2/455
2014/0359912 A1 * 12/2014 Sutton ..... A63B 71/1225 2/16

(56) References Cited

U.S. PATENT DOCUMENTS

| | | | | |
|---|---|---|---|---|
| 2015/0297973 | A1* | 10/2015 | Beers | A63B 71/12 2/461 |
| 2016/0059516 | A1* | 3/2016 | Harris | B32B 7/12 442/1 |
| 2016/0227857 | A1* | 8/2016 | Huff | A41D 31/00 |

* cited by examiner

PADDING SYSTEM FOR MEDICAL CLOTHING

CROSS-REFERENCE TO RELATED APPLICATIONS

This application claims priority to U.S. Provisional Application No. 61/930,560, filed Jan. 23, 2014, the entireties of which are herein incorporated by reference.

BACKGROUND OF THE INVENTION

1. Field of the Invention

The present invention relates in general to the field of clothing primarily used in the veterinary field. More particularly, the present invention relates to scrub uniforms including pants and tops. Specifically, a preferred embodiment of the present invention relates to scrub pants used in animal healthcare, or veterinary clinics.

2. Discussion of the Related Art

The present invention relates to medical clothing and uniforms which is meant to include all forms of medicine such as veterinary care. More specifically, the present invention pertains to a scrub uniform and an improvement thereof, wherein a scrub garment is disclosed having padding built into the knee region of the uniform.

Scrubs may be disposable or reusable to provide a uniform appearance of medical staff. The scrubs may be laundered by the medical facility and help control the sterilization of the workplace. The scrubs may also prevent a doctor or technician from soiling their own, personal clothing.

The structure of scrubs generally consists of a disconnected short-sleeve shirt and pants. The scrub material may include uniform thickness and providing a thin barrier between the user and the environment. This configuration is well suited for providing a physical harrier for dirt and blood while in a medical environment, but provides little in the way of protection to the wearer's knees when repeatedly kneeling on the floor when treating animals. In these conditions, it is common for medical personnel to use anti-fatigue mats to cushion the floor, or even wear knee pads. Not only can these devices impose a significant cost burden on the practitioner, but they can also clutter a treatment room or introduce another item that is susceptible to passing pathogens from one patient to another.

Separate knee pads also do not contribute to the professional look that many healthcare providers try to purport. Knee pads tend to make a practitioner look less professional and less uniform than other care providers within the same office.

What is therefore needed is a knee padding system that is not noticeable to a third party yet provides cushioning to the knees when kneeling down. What is also needed is a way to integrate a padding device into the joint area of commonly worn scrub pants. What is furthermore needed is a low-cost knee padding device that maintains scrub uniform affordability for treatment clinics.

SUMMARY AND OBJECTS OF THE INVENTION

A pair of scrub pants may be fashioned with a knee padding to be worn by a user. The pants may include a pair of legs, a knee area on each leg, and a thigh area on each leg. Each leg area may include an interior section and an exterior section with a length of sufficient size to conceal a thigh area and a knee area of a user.

A pad, or padding, may be permanently affixed to each one of the knee areas of the legs. A first stitching exposed on the exterior section of the pants may for a repeated pattern of stitching in the knee area of the pants. The padding may be formed of a plurality of layers, each layer joined to one another with a second stitching separate from the first stitching. Each one of the layers may further include a surface area progressively larger than an adjacent layer thus forming a pyramidal shape. The plurality of layers may include a first padding with a first surface area and a second padding with a second surface area that is less than the first padding.

The first stitching which forms the repeated geometric pattern may form a four sided diamond pattern with each one of the sides being equal in length. A material sewn to form a pocket on the interior section of the pants may conceal the padding in each leg.

The padding may also be formed with a top layer with a surface area and a base layer opposite the top layer with a surface area larger than the top area. A plurality of layers may be sandwiched in between the base layer and top layer with each one of the layers having increasing surface areas thus forming substantially pyramidal shape. A separate and distinct material may substantially cover the knee padding in the knee area of the interior section of each leg. In one embodiment, the stitching that permanently affixes the material does not form the geometric pattern on the exterior knee area of the scrub pants. Additionally, in one embodiment the geometric pattern may form a desired company logo or any other image.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a pan of this specification, wherein like reference numerals designate the same elements in the several views, and in which.

Figure 1:
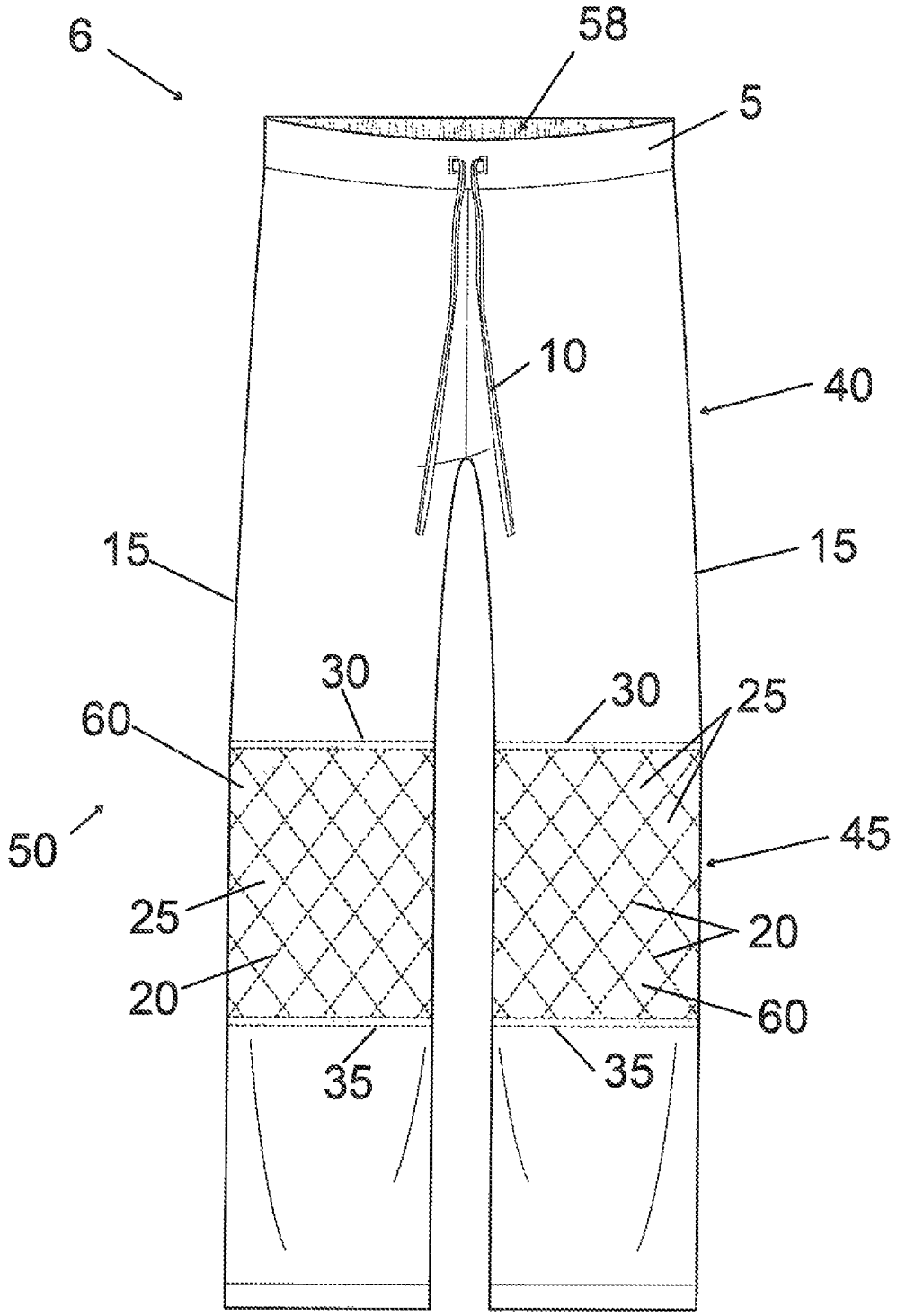
FIG. 1 illustrates a front view of scrub pants according to one embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF EMBODIMENTS

The present invention and the various features and advantageous details thereof are explained more fully with reference to the non-limiting embodiments described in detail in the following description.

Figure 2:
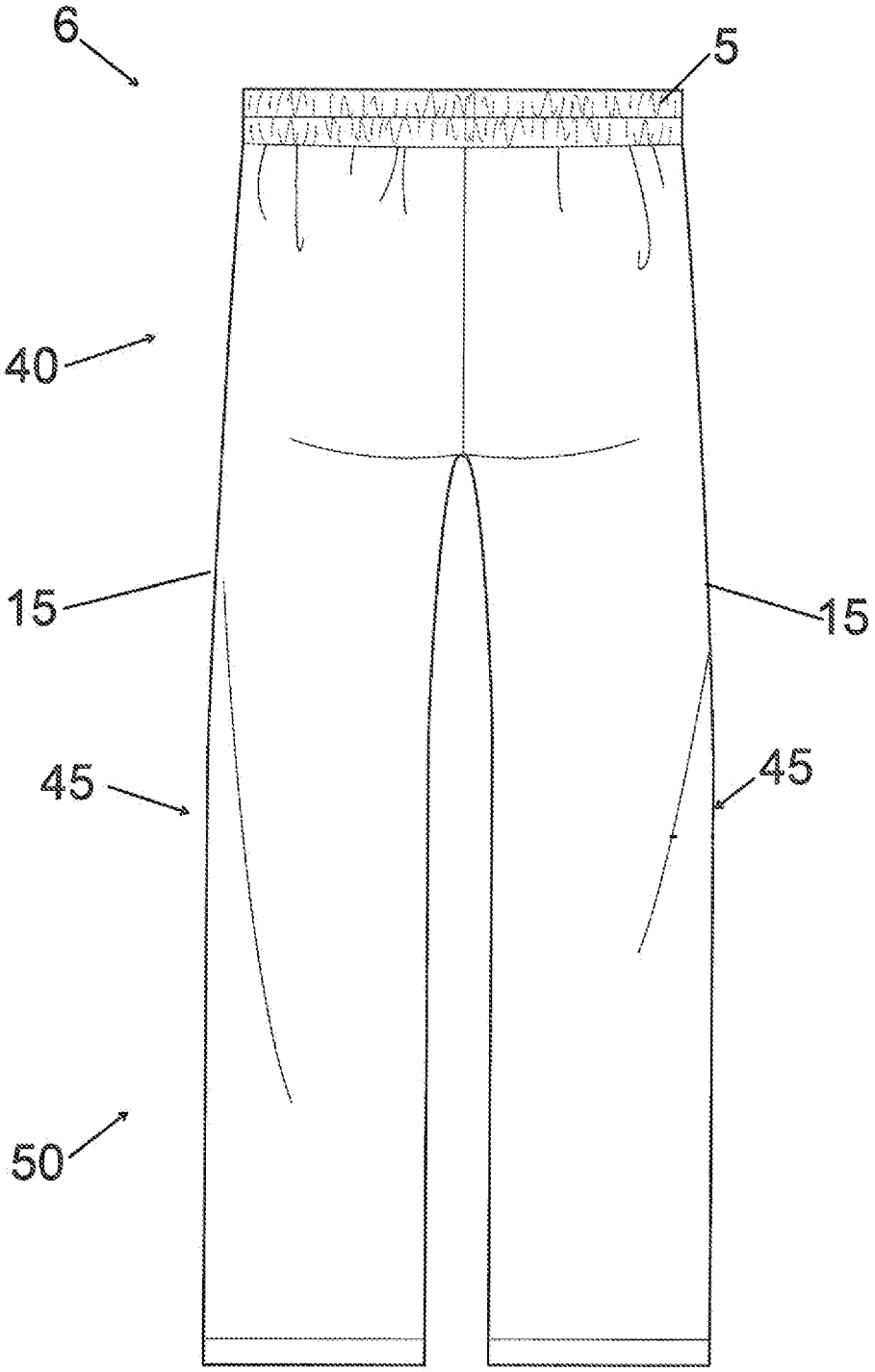
FIG. 2 illustrates a back view of the scrub pants according to FIG. 1.
Figure 3:
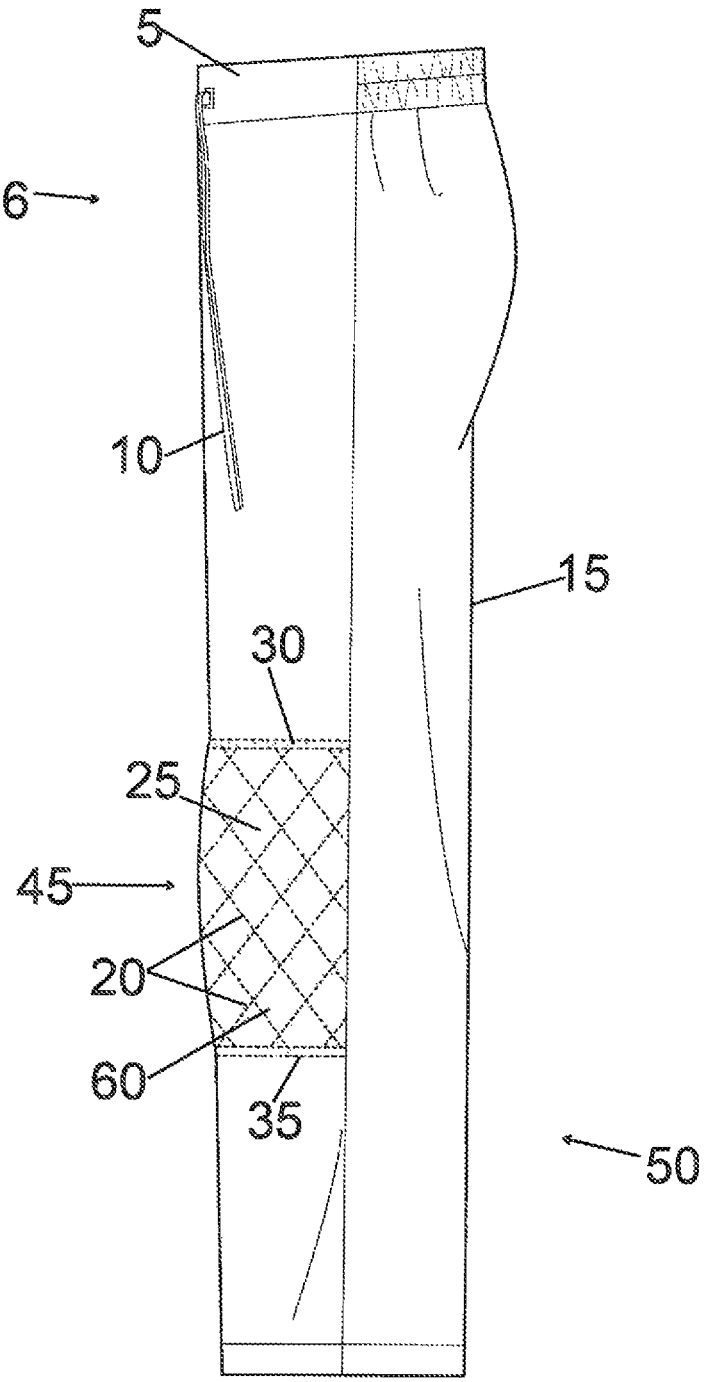
FIG. 3 illustrates a side view of the scrub pants according to FIG. 1.

Referring to FIGS. 1-3, the scrub pants 6 are shown. The scrub pants 6 include a waist band 5, which may be elastic, and a draw string 10 to adjust the waist band 5 to the user's comfortable size. As scrub pants 6 are commonly sold in sizes such as small, medium, large, and extra large, the draw string 10 and adjustable waist band 5 allow for great flexibility in accommodating people of many shapes and sizes.

The scrub pants 6 include two legs 15, each having a thigh area 40 that fully encloses a user's thigh area 40 as well as a knee area 45 that encloses a user's knees. While full-length scrub pants 6 are shown, the length may vary to accommodate different needs.

On the exterior section 50 of each leg 15, a first stitching, or stitching 20, is shown that forms a diamond 25 pattern, much like a checkerboard pattern, in the knee area. While diamond patterns 25 are shown, any geometric shape may be created by the stitching including, but not limited to circles, squares, triangles, logos, wording, numbers, or the like. Preferably, the stitching 20 forms a uniform pattern on each leg 15.

Figure 4:
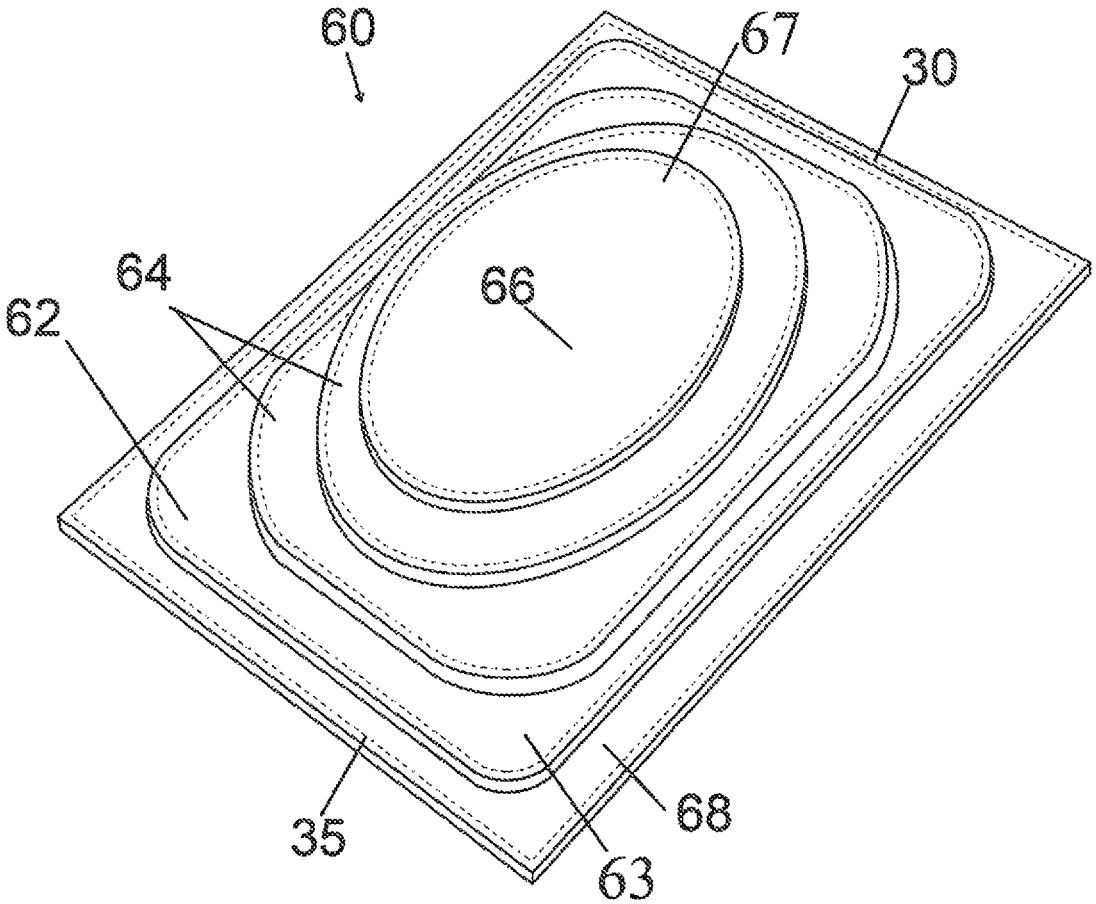
FIG. 4 illustrates a perspective view of padding for the scrub pants of FIG. 1.

The stitching 20 on the knee area 45 of each leg 15 not only provides an aesthetic function, but also secures a knee padding 60 in the interior section 58 of each leg 15. As shown in FIG. 4, a knee padding 60 is constructed from a plurality of layers. A first padding 63, or base layer 62, intermediate layers 64, and a second padding 67, or top layer 66, form the knee padding 60. Material 68 may be used to conceal the knee padding 60 in the interior section 58 of each leg 15 forming a pocket to conceal the knee padding 60 and preventing a user's foot from getting caught on the knee padding 60 when putting on the scrub pants 6.

The base layer 62 preferably includes a surface area that is larger than the surface area of the other layers 64, 66. Each successive layer following the base layer 62 has a smaller surface area, allowing the top layer 66 to have the smallest surface area. While the intermediate layers 64 are shown with two pads, any number of pads may be layered in a similar "stepped pyramid" manner to provide a gradually diminishing surface area with each successive layer.

The top layer 66 is preferably secured against the interior section 58 of each leg 15 at the knee area 45. By attaching the knee padding 60 in this orientation, the stepped structure of the knee padding 60 created the contour of a knee cap when a user wears the scrub pants. This minimizes the appearance of padding in the knee area 45 which may look unprofessional or give the scrub pants 6 a bulky look. In other words, the knee padding 60 includes a stepped shape that helps camouflage it within the knee area 45.

When attaching the knee padding 60 to the interior section 58 of the knee area 45 of each leg 15, the base layer 62, intermediate layers 64, and top layer 66 are sewn to the knee area with stitching 20 that creates the diamonds 25. The material 68 may then be sewn to the interior section 58 of the knee area 45 to camouflage the knee padding 60 from sight, should the interior section 58 be inspected. A second stitching 30 secures each one of the intermediate layers 64 to the top layer 66 and base layer 62. Bottom stitching 35 secures the perimeter of the material 68 to the knee area on the interior of the legs 15. Stitching 20 forms the diamonds 25 and is preferably separate from other stitching and preferably not visible on the interior section of the scrub pants 6 as it is concealed by the material 68.

Figure 5:
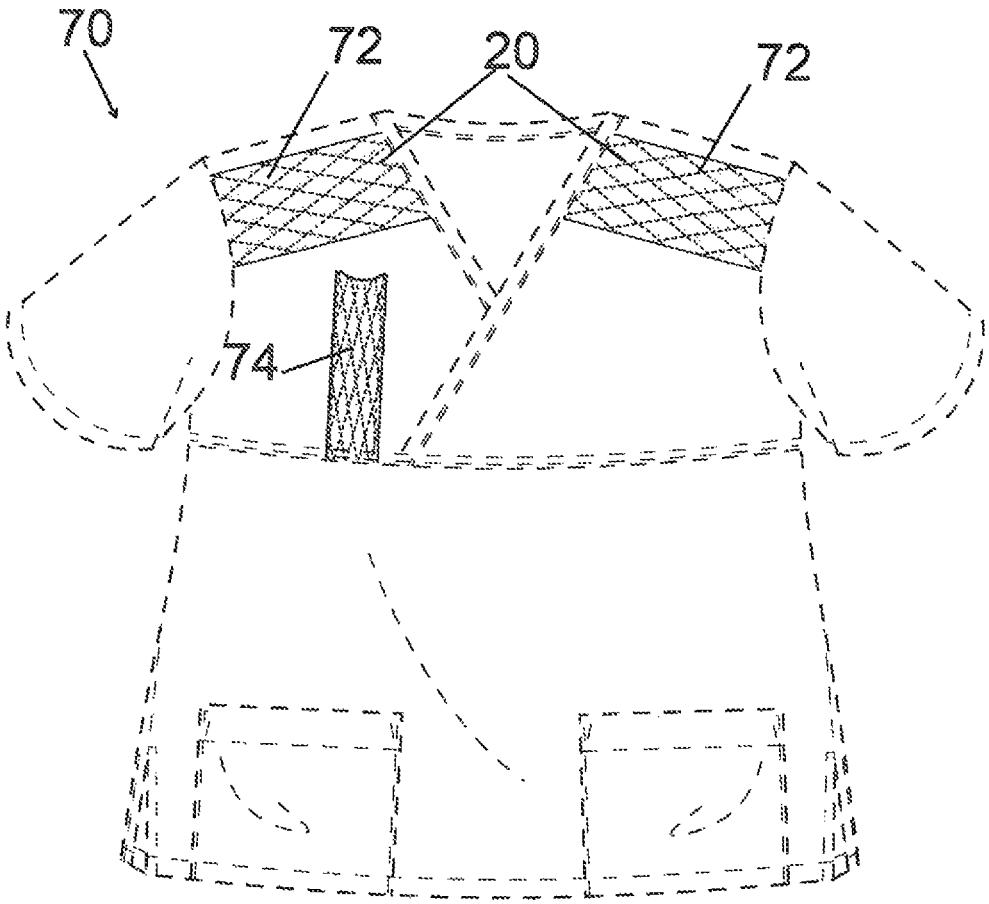
FIG. 5 illustrates a front view of a scrub top according to another embodiment of the invention.

Turning now to FIG. 5, the stitching 20 forming the diamonds 25 may be duplicated on a matching top 70. The top 70 may include shoulder pads 72 and also a pocket 74 that uses the same stitching 20 as the scrub pants 6 creating a similar diamond 25 pattern. While the stitching 20 on the top 70 is primarily for aesthetic reasons, padding may similarly be attached in needed areas such as elbows (not shown). The matching diamonds on the top 70 and the scrub pants 6 provide a uniform that is both functional in preventing joint fatigue and also an aesthetically pleasing uniform.

The knee padding 60 may also be incorporated into other components of a scrub uniform such as a top. While the top may be long sleeved or short sleeved, a long sleeve variant may include a similar pad 60 in the elbow area. As a result, the knee pad may be incorporated with similar design and construction in any joint area of a scrub uniform.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

It is intended that the appended claims cover all such additions, modifications and rearrangements. Expedient embodiments of the present invention are differentiated by the appended claims.

What is claimed is:

1. Apparel for providing a knee padding to be worn by a user comprising:

a scrub pants including a pair of legs, a knee area on each leg, and a thigh area on each leg, said legs including an interior section and an exterior section with a length adapted to conceal a thigh area and a knee area of a user; and a padding not readily removable to each one of the knee areas of the legs, a first stitching exposed on the exterior section of the scrub pants; and a plurality of layers forming the padding, the plurality of layers including a base layer, a first other layer, a second other layer, and a top layer where each layer is joined to one another with a second stitching separate from the first stitching, and wherein each one of the layers has a surface area progressively larger than an adjacent layer, where the plurality of layers forms a layered stepped pyramid to provide a gradually diminishing surface area with each successive layer; wherein the base layer has a first surface area and is rectangular in shape, the first other layer has a second surface area that is smaller than the first surface area and is rectangular in shape, the second other layer has a third surface area that is smaller than the second surface area and is oval in shape, and the top layer has a fourth surface area that is smaller than the third, surface area and is oval in shape.

2. The apparel for providing a knee padding to be worn by a user of claim 1, wherein the first stitching and the second stitching form a repeated geometric pattern of stitching in the knee area of the scrub pants, wherein the repeated geometric pattern includes a four sided diamond pattern, each side of the four sided diamond pattern being equal in length.

3. The apparel for providing a knee padding to be worn by a user of claim 1, wherein the padding is concealed in a pocket.

4. The apparel for providing a knee padding to be worn by a user of claim 3, further comprising a separate and distinct material substantially covering the knee padding in the knee area of the interior section of each leg, wherein the material prevents the user's foot from catching on the plurality of layers.

5. The apparel for providing a knee padding to be worn by a user of claim 1, wherein the layered stepped pyramid is configured to support the knee area of the user.

6. The apparel for providing a knee padding to be worn by a user of claim 1, wherein the top layer is secured to the interior section of each leg.

7. The apparel for providing a knee padding to be worn by a user of claim 1, wherein the layered stepped pyramid forms a contour adapted to contour to a knee cap of a user.

8. The apparel for providing a knee padding to be worn by a user of claim 4, wherein the material is sewn to the interior section to camouflage the plurality of layers.

9. Apparel for providing a knee padding to be worn by a user comprising:

a scrub pants including a pair of legs, a knee area on each leg, and a thigh area on each leg, said legs including an interior section and an exterior section with a length adapted to conceal a thigh area and a knee area of a user;

a padding not readily removable to each one of the knee areas of the legs, a first stitching exposed on the exterior section of the scrub pants;

a plurality of layers forming the padding, the plurality of layers including:

a base layer with a first surface area, where the base layer is rectangular in shape, a first other layer with a second surface area that is smaller than the first surface area, where the first other layer is rectangular in shape, a second other layer with a third surface area that is smaller than the second surface area, where the second other layer is oval in shape, and a top layer with a fourth surface area that is smaller than the third surface area, where the top layer is oval in shape, and where the top layer is secured to the interior section of each leg;

where the plurality of layers forms a layered stepped pyramid to provide a gradually diminishing surface area with each successive layer;

a second stitching separate from the first stitching, where the second stitching joins the plurality of layers to one another; and a separate and distinct material substantially covering the knee padding in the knee area of the interior section of each leg;

wherein the first stitching and the second stitching form a repeated geometric pattern of stitching in the knee area of the scrub pants;

wherein the layered stepped pyramid allows the plurality of layers to be concealed within the interior section of the scrub pants;

wherein the layered stepped pyramid forms a contour adapted to contour to a knee cap of a user, wherein the material prevents the user's foot from catching on the plurality of layers; and wherein the material is sewn to the interior section to camouflage the plurality of layers.

10. The apparel for providing a knee padding to be worn by a user of claim 9, wherein the material forms a pocket that conceals the padding.

11. The apparel for providing a knee padding to be worn by a user of claim 9, wherein the repeated geometric pattern includes a four-sided diamond pattern, each side of the four-sided diamond pattern being equal in length.

* * * * *